US011903504B2

(12) United States Patent
Gzybowski

(10) Patent No.: US 11,903,504 B2
(45) Date of Patent: Feb. 20, 2024

(54) SHOE HORN WITH CUFF LIFTER

(71) Applicant: Michael S. Gzybowski, Ann Arbor, MI (US)

(72) Inventor: Michael S. Gzybowski, Ann Arbor, MI (US)

( * ) Notice: Subject to any disclaimer, the term of this patent is extended or adjusted under 35 U.S.C. 154(b) by 0 days.

(21) Appl. No.: 17/852,955

(22) Filed: Jun. 29, 2022

(65) Prior Publication Data

US 2023/0034549 A1 Feb. 2, 2023

Related U.S. Application Data

(60) Provisional application No. 63/226,544, filed on Jul. 28, 2021.

(51) Int. Cl.
*A47G 25/82* (2006.01)

(52) U.S. Cl.
CPC ..... *A47G 25/82* (2013.01)

(58) Field of Classification Search
CPC ..... A47G 25/80; A47G 25/82
See application file for complete search history.

(56) References Cited

U.S. PATENT DOCUMENTS 10,582,792 B1 * 3/2020 LaRue ..... A47G 25/82
2020/0245797 A1 * 8/2020 Kim ..... A43B 11/02

* cited by examiner

*Primary Examiner* — F Griffin Hall

(57) ABSTRACT

A shoe horn that can be used to lift clothing that would otherwise get in the way when putting on a shoe with a shoe horn. The shoe horn includes: a handle portion having a central axis; a tongue portion having a central axis; an offset transition portion between the handle portion and the tongue portion at which the central axis of the handle portion and the central axis of the tongue portion are offset from one another; and at least one appendage extending outward and upward from a front of the shoe horn at or above the offset transition portion. When using the shoe horn to put on a shoe a user first engages and lifts the lower portion clothing out of the way, then uses the shoe horn to guide a foot into a shoe.

9 Claims, 2 Drawing Sheets

SHOE HORN WITH CUFF LIFTER

BACKGROUND

The present invention relates generally to shoe horns that are used to assist a person in inserting their feet into shoes and more particularly to shoe horns that have hem or cuff lifting appendages.

Long shoe horns that can range from 18 to 30 inches long are generally used by people that have difficulty bending over to reach their shoes as needed to use shorter shoe horns.

When using a long shoe horn to put one's shoes on, persons wearing long pants often need to lift up the cuffs of such long pants with one hand and use their other hand to insert the lower end of the shoe horn into the back heel portion of a shoe. In a similar manner women wearing longer clothing such as dresses or skirts often need to lift up the hem of such longer clothing with one hand and use their other hand to insert the lower end of the shoe horn into the back heel portion of a shoe.

For many people, and in particular elderly people, they often need to steady themselves when standing on one foot by using a free arm/hand to grasp a support such as a chair back or lean on some structure such as a wall or door post in order to prevent losing their balance and possibly falling down.

It thus is understandable that when using a long shoe horn to put on one's shoes in a manner that requires using one hand to raise one's pants cuffs or clothing hem and manipulating the shoe horn in the other hand, people can be in danger of losing their balance and stumbling if not falling down.

The present invention provides a long shoe horn that includes an appendage that allows one to use one hand to raise or lift one's pants cuffs or clothing hem and guide their feet into shoes.

BRIEF SUMMARY

According to various features, characteristics and embodiments of the present invention which will become apparent as the description thereof proceeds, the present invention provides a shoe horn for aiding putting on a shoe that comprises:

- a handle portion having a central axis;
- a tongue portion having a central axis;
- an offset transition portion between the handle portion and the tongue portion at which the central axis of the handle portion and the central axis of the tongue portion are offset from one another; and
- at least one appendage extending outward and upward from a front of the shoe horn at or above the offset transition portion.

The present invention further provides a method of putting a shoe on a foot with a shoe horn which comprises:

- providing a shoe horn that includes:
  - a handle portion having a central axis;
  - a tongue portion having a central axis;
  - an offset transition portion between the handle portion and the tongue portion at which the central axis of the handle portion and the central axis of the tongue portion are offset from one another; and
  - at least one appendage extending outward and upward from a front of the shoe horn at or above the offset transition portion;
- engaging the lower portion of an article of clothing with the at least one appendage;

- lifting the lower portion of the article of clothing with the shoe horn;
- inserting the tongue portion into a back heel portion of a shoe;
- guiding a foot into the shoe using the tongue portion;
- removing the tongue portion from the shoe; and
- disengaging the lower portion of the article of clothing from the at least one appendage.

BRIEF DESCRIPTION OF THE DRAWINGS

The present invention will be described with reference to the attached drawings which are given as non-limiting examples only, in which.

DETAILED DESCRIPTION OF THE DRAWINGS AND THE PRESENTLY PREFERRED EMBODIMENTS

The shoe horn of the present invention includes a handle portion with a tongue portion located at a lower end of the handle portion. The tongue portion has a central axis that is offset from the central axis of the handle portion. A transition portion between the handle portion and the tongue portion can have an angular shape or a curved shape the provides the offset between the central axis of the tongue portion and the central axis of the handle portion. The offset provides clearance for an appendage that extends outward from the front or sides of the shoe horn above the tongue portion, which appendage is configured to allow a user to engage the bottom of one's pants' cuff or clothing hem to raise or lift the same when using the shoe horn to put on a shoe. As discussed below, the clearance is provided so that the appendage does not contact the back of a user's leg when using the shoe horn to put on a shoe.

The handle portion and the tongue portion of the shoe horn can each have a curved cross-sectional shape that is concave toward the back of the shoe horn. In other embodiments the handle portion can be tubular shaped or flat or have any suitable shape.

The overall length of the shoe horn should be long enough to enable a user to use the shoe horn to put on one's shoes while standing. A suitable length of from about 16 to 30 inches or longer will allow a person to put on their shoes while standing or slightly bending over. An even smaller overall length can be suitable when one is partially or fully bending over to put on a shoe. In each case the shoe horns of the present invention will assist in lifting one's pants' cuffs or clothing hem when putting on a shoe.

The shoe horns of the present invention can be formed from a metal or molded from a plastic material.

Figures 1A, 1B, 1C:
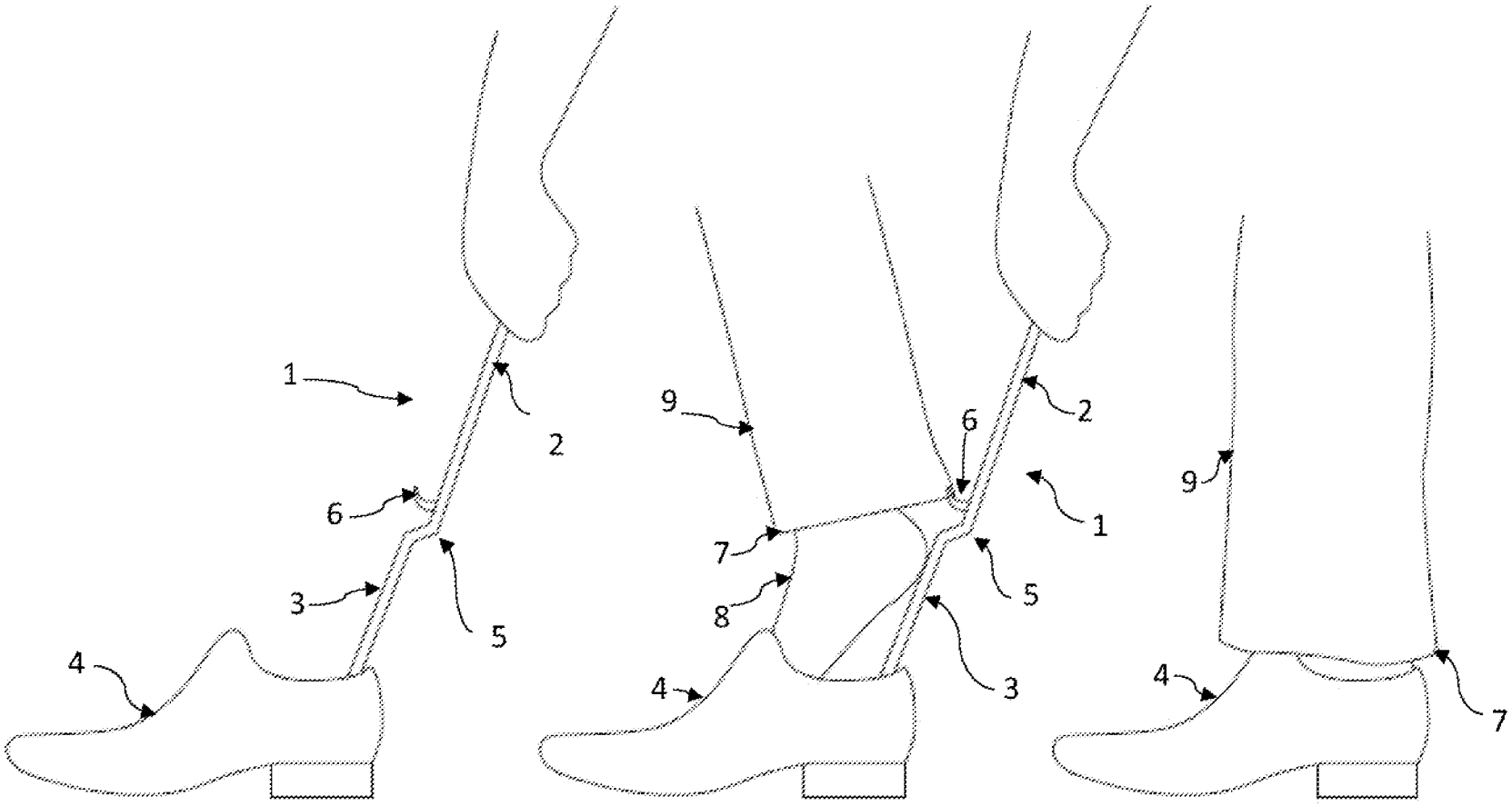
FIG. 1*a* is side view of a shoe with a shoe horn according to the present invention positioned into the heel portion of the shoe.
FIG. 1*b* is a side view of a person inserting their foot into a shoe using the shoe horn of FIG. 1*a* according to the present invention.
FIG. 1*c* is a side view of a person's foot position in the shoe of FIG. 1*a*.

FIG. 1*a* is side view of a shoe with a shoe horn according to the present invention positioned into the heel portion of the shoe.

FIG. 1*b* is a side view of a person inserting their foot into a shoe using the shoe horn of FIG. 1*a* according to the present invention.

FIG. 1*c* is a side view of a person's foot position in the shoe of FIG. 1*a*.

As shown in FIG. 1*a* the shoe horn 1 has a handle portion 2 and a tongue portion 3 at the lower end of the handle portion 2 which tongue portion 3 is configured to be inserted into the back heel portion of shoe 4. As shown, the central axis of the tongue portion 3 is offset from the central axis of the handle portion 2 so as to extend outward in front of the handle portion. The offset is defined by a transition portion 5 that is depicted as being angular in FIG. 1*a*. In other embodiments the transition portion 5 could be curved.

An appendage 6 extends outward from the front of the shoe horn above the transition portion 5. The appendage 6 is configured to engage the bottom of one's pants' cuff or clothing hem to raise of lift the same when using the shoe horn 1 to put on a shoe. The appendage 6 can have a J-shaped or L-shape hook configuration or have a straight shape that angles upward. Other configurations of the appendage that will engage one's pants' cuff or clothing can be used. In some embodiments more than one appendage can be used. The distal end of the appendage 6 should be turned back toward the handle portion 2 or otherwise be configured so as not to rub against the back of a user's leg. In this regard the distance that the appendage 6 extends outward from the handle portion 2 should about the same as the offset distance.

FIG. 1*b* is a side view of a person inserting their foot into a shoe using the shoe horn of FIG. 1*a* according to the present invention.

As shown in FIG. 1*b*, when using a shoe horn 1 according to the present invention a user first lowers the appendage 6 and engages the bottom of the user's pants' cuff 7 with the appendage 6 and lifts the pants' cuff upward away from the back of the user's foot 8 and away from the shoe 4. Next, the user positions the tongue portion 3 of the shoe horn 1 into the back of the heel portion of the shoe 4 and uses the tongue portion 3 of the shoe horn 1 to guide the user's foot 8 into the shoe 4. Next the user lifts the shoe horn 1 so that the tongue portion 3 slides out of the shoe 4 and then the user lowers the shoe horn 1 so that the appendage 6 disengages the user's pants' cuff. In a similar manner a user can engage the hem of a dress or skirt with the appendage 6 to lift the bottom of the dress or skirt upward when using the shoe horn 1 to put on a pair of shoes.

FIG. 1*c* is a side view of a person's foot position in the shoe of FIG. 1*a*. FIG. 1*c* depicts how the cuff 7 of the user's pants 9 normally covers the top portion of shoe 4 once the user's foot 8 is positioned in the shoe 4. As can be appreciated, when a person wearing pants 9 or other article of clothing that is similarly long and points their foot 8 down to put on a shoe 4 (See FIG. 1*b*), the heel of the person's foot 8 will naturally pivot upward and be covered by the back of the pants' cuff 7. As a result, the tongue portion 3 of a shoe horn 1 cannot be easily inserted into the back heel portion of a shoe 4 with the pants cuff 7 in the way. In the case of using a conventional shoe horn, the user would have to lift his or her pants' cuff with one hand and manipulate the shoe horn with the user's other hand.

According to the present invention a user can use the appendage 6 on the shoe horn 1 to lift or raise his or her pants' 9 out of the way to put on a shoe 4 using a shoe horn 1 according to the present invention.

Figures 2, 3, 4, 5, 6:
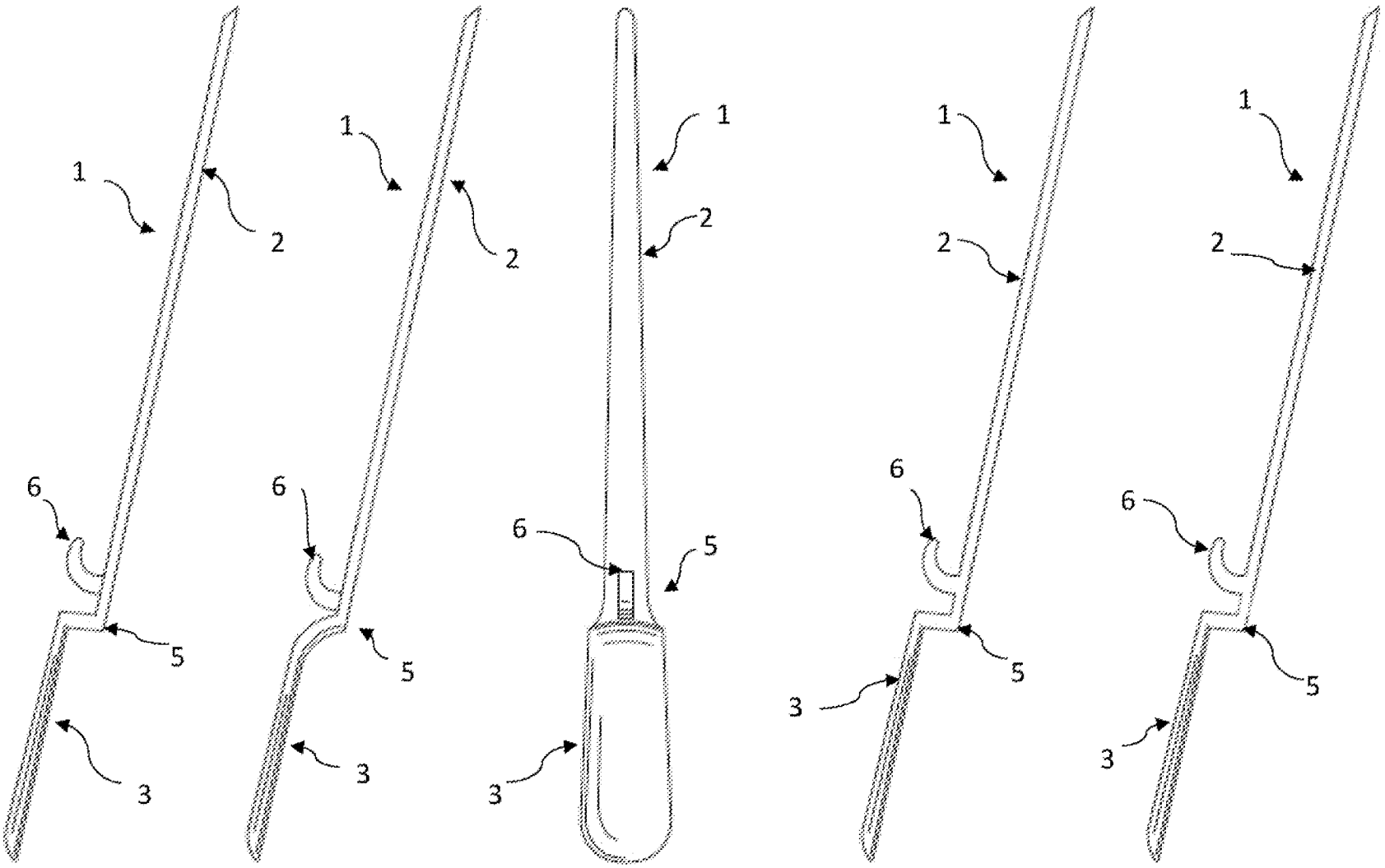
FIG. 2 is a side view of a shoe horn according to one embodiment of the present invention.
FIG. 3 is a side view of a shoe horn according to another embodiment of the present invention.
FIG. 4 is a front view of a shoe horn according to one embodiment of the present invention.
FIG. 5 is a cross-sectional view of the shoe horn of FIG. 4 taken along section line V-V.
FIG. 6 is a cross-sectional view of a shoe horn similar to FIG. 5 that has a different appendage feature according to another embodiment of the present invention.

FIG. 2 is a side view of a shoe horn according to one embodiment of the present invention.

The shoe horn 1 in FIG. 2 has a transition portion 5 that defines an offset between the axis of the handle portion 2 and the axis of tongue portion 3 that has an angular shape. The appendage 6 extends outward from the front of the shoe horn 1 above the transition portion 5 and extends outward to a distance that is about the same as the offset distance between the handle portion 2 and the tongue portion 3.

FIG. 3 is a side view of a shoe horn according to another embodiment of the present invention.

The shoe horn 1 in FIG. 3 has a transition portion 5 that defines an offset between the axis of the handle portion 2 and the axis of tongue portion 3 that has an angular shape. The appendage 6 extends outward from the front of the shoe horn 1 above the transition portion 5 and extends outward to a distance that is about the same as the offset distance between the handle portion 2 and the tongue portion 3.

FIG. 4 is a front view of a shoe horn 1 according to one embodiment of the present invention. The handle portion 2 and the tongue portion 3 of the shoe horn 1 in FIG. 4 each have a curved cross-sectional shape that is concave toward the back of the shoe horn 1. In other embodiments the handle portion 2 can be tubular shaped or flat or have any suitable shape.

In the embodiment of FIG. 4 the appendage 6 extends outward from the face of the shoe horn 1 above the transition portion 5 between the handle portion 2 and the tongue portion 3. In FIG. 4 the appendage 6 extends outward from the center of the face of the shoe horn 1. In other embodiments one or more appendages could extend outward from one or both sides of or above the transition portion 5 of the shoe horn 1.

FIG. 5 is a cross-sectional view of the shoe horn of FIG. 4 taken long section lines V-V.

In the embodiment shown in FIG. 5 the appendage 6 is a separate element that is attached to the face of the shoe horn 1 by any suitable manner such as gluing, using mechanical fasteners, etc. In other embodiments an appendage 6 as shown in FIG. 5 could be molded together with a plastic molded shoe horn 1. Still in other embodiments the appendage 6 could be adjustably attached on the shoe horn, for example magnetically or by providing mounting pins on the back of the appendage 6 that can be engaged and held in any of a series of mounting holes provided in the shoe horn 1 at or above the transition portion 5.

FIG. 6 is a cross-sectional view of a shoe horn similar to FIG. 5 that has a different appendage feature according to another embodiment of the present invention.

In FIG. 6 the appendage 6 is formed by cutting an outline of the top and sides of the appendage 6 in the face of the shoe horn 1 and bending the appendage 6 (while attached along the bottom portion) outward and upward.

The overall length of the shoe horn of the present invention can range from 8 to 30 inches or longer, with longer lengths allowing a user to put on a pair of shoes without bending over.

The relative lengths of the handle portion 2 and tongue portion 3 and offset distance provided by the transition portion 5 can be varied as desired to provide the functional utility described herein. A tongue portion 3 having a length of from about 3.5 inches to about 5 inches or more would be suitable. The handle portion 2 or an upper length of the handle portion 2 could have a curved shape other then being straight as show. An offset distance of about 1 inch or larger would be suitable.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and set forth in the attached claims.

The invention claimed is:

1. A shoe horn for aiding putting on a shoe that comprises:

a handle portion having a central axis at one end of the shoe horn;

a tongue portion having a central axis at another opposite end of the shoe horn;

an offset transition portion between the handle portion and the tongue portion at which the central axis of the handle portion and the central axis of the tongue portion are offset from one another by a distance; and at least one appendage spaced apart from the tongue portion and extending outward and upward from a front of the shoe horn at or above the offset transition portion, said at least one appendage having a free end that extends upward and away from the tongue portion.

2. A shoe horn for aiding putting on a shoe according to claim 1, wherein the transition portion has an angular shape.

3. A shoe horn for aiding putting on a shoe according to claim 1, wherein the transition portion has a curved shape.

4. A shoe horn for aiding putting on a shoe according to claim 1, wherein the at least one appendage comprises a single appendage.

5. A shoe horn for aiding putting on a shoe according to claim 4, wherein the single appendage extends outward from a center of the shoe horn.

6. A shoe horn for aiding putting on a shoe according to claim 1, wherein the shoe horn is molded from a plastic material.

7. A shoe horn for aiding putting on a shoe according to claim 1, wherein the shoe horn is made from a metal.

8. A shoe horn for aiding putting on a shoe according to claim 1, wherein the at least one appendage has a curved shape.

9. A shoe horn for aiding putting on a shoe according to claim 1, wherein the at least one appendage has a linear shape.

* * * * *